US006105171A

United States Patent [19]

Niedermeyer

[11] Patent Number: 6,105,171

[45] Date of Patent: Aug. 22, 2000

[54] APPAREL WITH PANEL ATTACHMENTS ALONG SELECTED MARGINS

[76] Inventor: William P. Niedermeyer, 1024 Mt. Mary Dr., Green Bay, Wis. 54311

[21] Appl. No.: 09/192,142

[22] Filed: Nov. 14, 1998

[51] Int. Cl.[7] ..... A41B 9/00; A41D 10/00; A41D 27/24

[52] U.S. Cl. ..... 2/114; 2/109; 2/275

[58] Field of Search ..... 2/275, 274, 114, 2/78.1, 109, 111, 400

[56] References Cited

U.S. PATENT DOCUMENTS

| | | | |
|---|---|---|---|
| 1,765,411 | 6/1930 | Foote . | |
| 2,035,849 | 3/1936 | Underwood . | |
| 2,042,629 | 6/1936 | Ransom . | |
| 2,164,036 | 6/1939 | Lane . | |
| 2,202,977 | 6/1940 | Woodall . | |
| 2,515,450 | 7/1950 | Hull . | |
| 3,012,249 | 12/1961 | Laszlo . | |
| 3,036,311 | 5/1962 | Zimmerman et al. . | |
| 3,490,072 | 1/1970 | Keltner . | |
| 4,554,684 | 11/1985 | Cadoret | 2/227 |
| 5,274,852 | 1/1994 | Hogan . | |
| 5,564,123 | 10/1996 | Grassick | 2/69 |
| 5,603,123 | 2/1997 | Chupa | 2/275 |

*Primary Examiner*—John J. Calvert
*Assistant Examiner*—Shirra L Jenkins

[57] ABSTRACT

An article of apparel comprising a first segment and a second segment of substantially similar shape, each having at least two side margins parallel to a central line and at least one margin at an angle to the central line. One segment has flap extensions along selected margins for folded securement to the other segment thus forming a garment with folded external seams. In a three segment embodiment, one panel is constructed from two similarly shaped half-width segments that are overlapped to form an openable panel, with resealable closure means. In another two panel embodiment, both half width panels are partially overlapped to form a central 2-ply area, portions of which are bonded together in a region that becomes the rear panel. After rear portions of the bonded segments are folded in half over and around a transverse fold line, front and rear panels are connected with side flaps. The overlapped area in the front panel remains unbonded to form an opening which is secured by resealable tapes or equivalent means.

11 Claims, 5 Drawing Sheets

FIG. 2
(PRIOR ART)
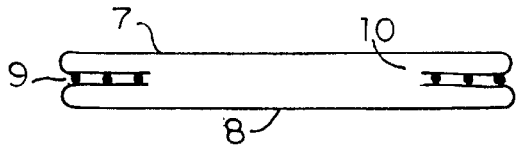
FIG. 1
(PRIOR ART)
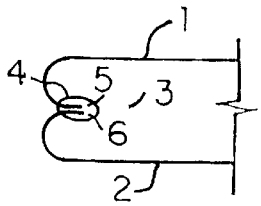
FIG. 3
(PRIOR ART)
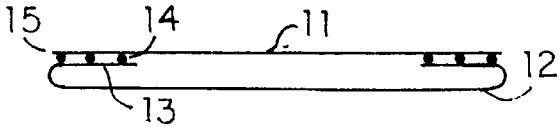
FIG. 4
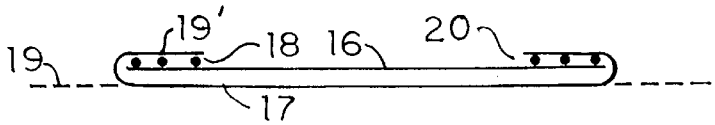
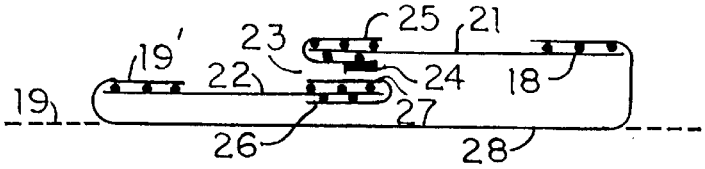
FIG. 5
FIG. 8
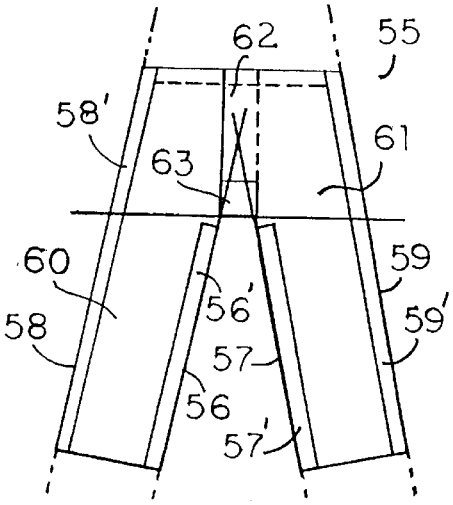
FIG. 9
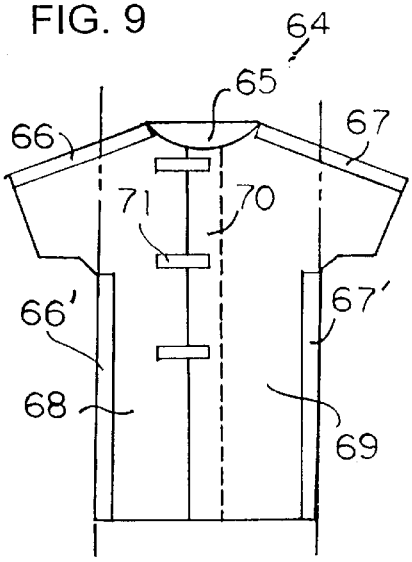

FIG. 6A
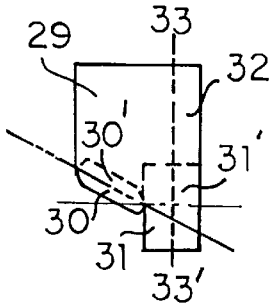
FIG. 6D
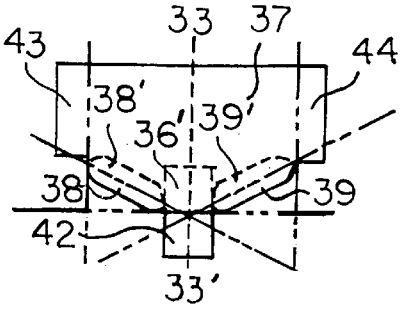
FIG. 6B
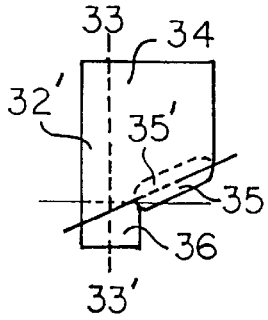
FIG. 6E
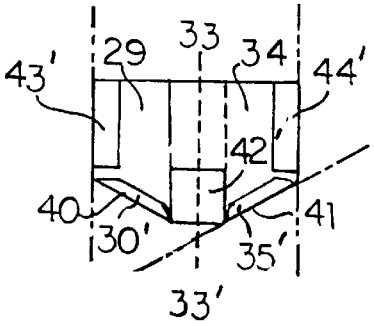
FIG. 6C
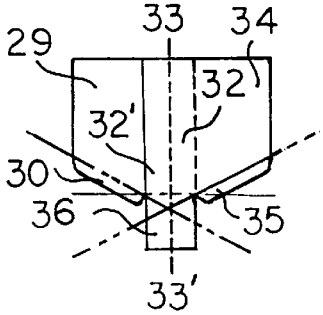
FIG. 7B
FIG. 7A
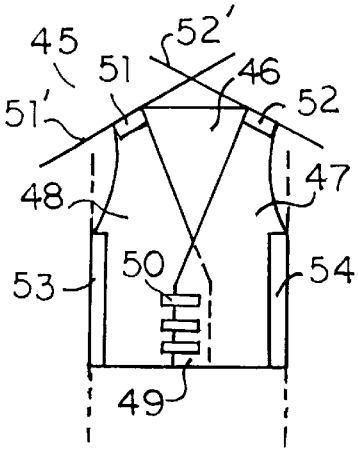
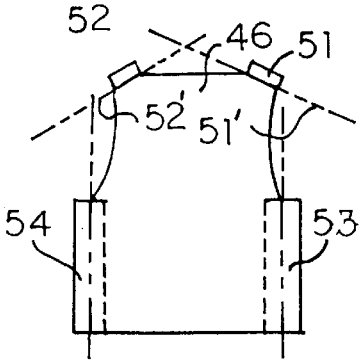

FIG. 10
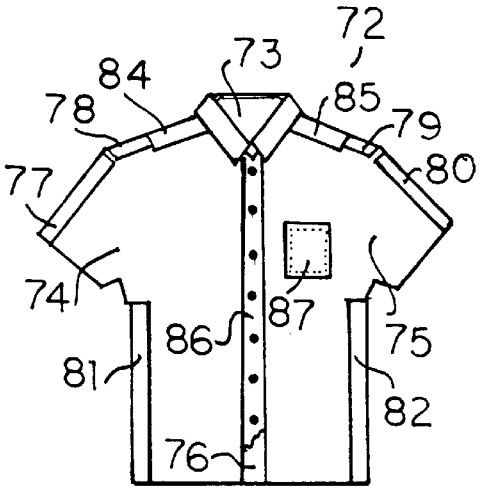
FIG. 12
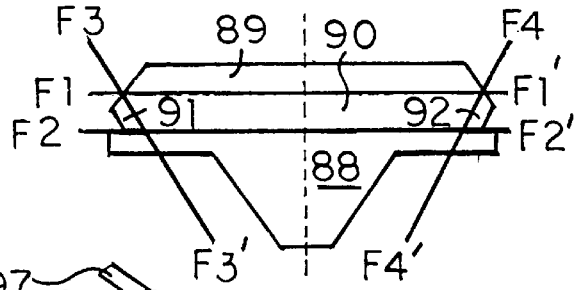
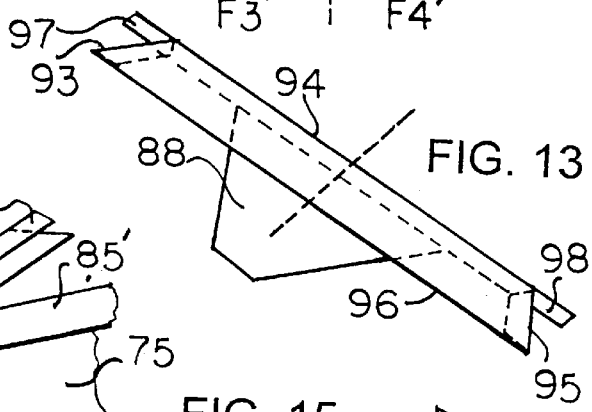
FIG. 13
FIG. 14
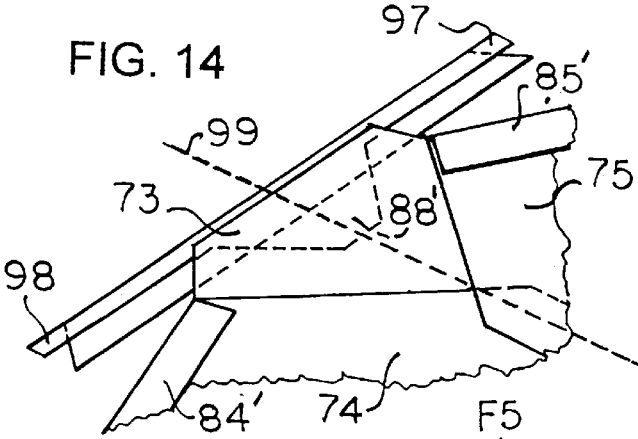
FIG. 15
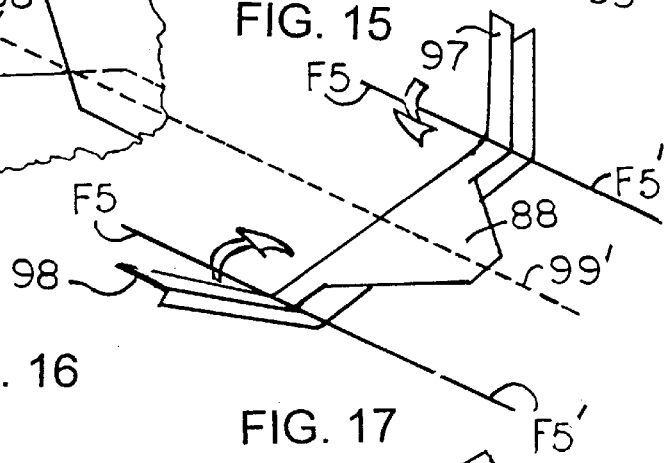
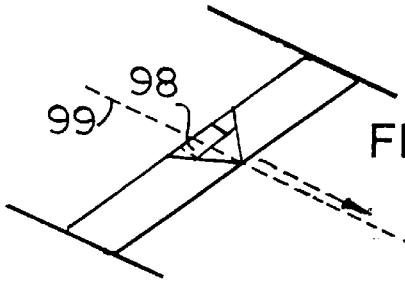
FIG. 16
FIG. 17
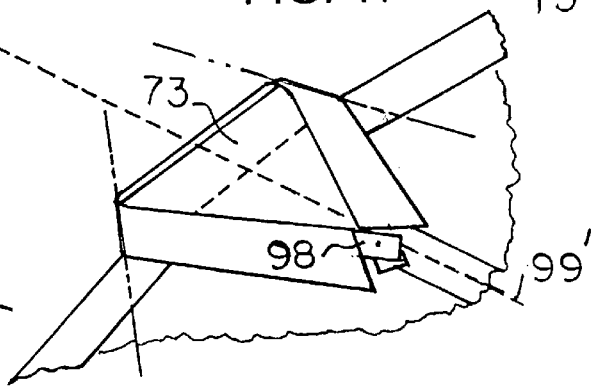
FIG. 11
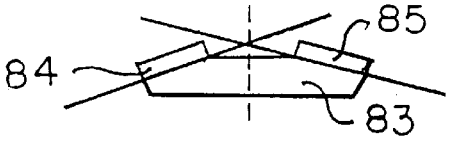

APPAREL WITH PANEL ATTACHMENTS ALONG SELECTED MARGINS

BACKGROUND

In general, textile garments and articles of apparel have similarly shaped front and rear panels that are superposed and seamed together along selected margins to enclose body parts.

These seams are sewn very close to the edges of the superposed panels to achieve good appearance and comfort when the garment is everted to place seams inside.

Seams on textile fabrics are machine sewn with individual panels and/or accessory pieces being manually manipulated for sewing.

The substitution of adhesives for sewing to connect panels is generally not acceptable because wider seams would be required for strength and once the garment is everted, these wider bonded seams would be uncomfortable against the wearer's body, particularly along the shoulders and regions of the lower torso.

Another major disadvantage with bonded seams for apparel worn over the body was the lack of seam strength, it being noted that the adhesive in bonded seams would be subject to separation by tension forces rather than shear—not unlike pulling a piece of tape from a surface rather than trying to slide it off.

For apparel (accessories) worn outside the body and not subject to seam failure by stress, bonded adhesives could be used, as in the textile fabric necktie of Zimmerman U.S. Pat. No. 3,036,311.

Textile fabrics are made of natural or synthetic fiber strands that are interwoven to form web lengths of woven fabric.

Using wet or dry forming methods, 'non-woven' fabrics are made of short length natural or synthetic fibers which are dispersed randomly in a continuous stream and bonded together with an agent to form a web of 'non-woven' fabric.

Various combinations of fiber material, length, thickness and density of the dispersed fibers, type of bonding agent used, and other factors can be selected to result in different non-woven fabric characteristics.

Because non-wovens do not involve making strands before being woven, and because of much higher web formation production speeds for forming webs, non-wovens are significantly lower in cost.

In the 1960's, these new materials were adapted to disposable diapers as a pervious liner to allow passage of fluids to absorbent pads that were superposed on the impervious outer panel of the diaper.

During the late 1960's, different disposable products using non-wovens and plastics were described for hospital, medical, and special use products, including U.S. Pat. Nos. 3,221,341 of Hummel for bibs, 3,451, 062 of Bradley for a disposable examination gown, 3,663,962 of Burger for panties, and 3,719,955 of Hrubecky for a disposable garment having a rectangular torso section.

With low cost materials available, it was important to develop methods for producing garments with adhsively bonded seams along margins that are parallel to, perpendicular to, and at angles to, the direction of product flow.

This invention describes products made with methods and apparatus of U.S. Pat. No. 5,795,433 which describes methods to place a shaped first panel segment having discreet flap extensions on a carrier cylinder, placing a similarly shaped second segment without flaps on top of the first segment, applying adhesive along selected margins of the second segment, and folding the flaps over and around the borders of the second segment panel to create shaped garments during advancement of the superposed segment assembly along the carrier cylinder path.

The above described method is used to make seams on the garments illustrated and described in the specifications of this invention, it being understood that the seams thus produced have special advantages and attributes listed as objectives in the "Summary of the Invention" below.

SUMMARY OF THE INVENTION

This application describes apparel with sloped shoulders for better fit and comfort, and includes garments with 'legs', overlapped front panel openings, and reinforced edges of overlapped panels. Shirts with triangularly folded collars are also described.

An important object of this invention is to provide form fitting garments having front and rear panel segments connected by seams folded along margins that extend in any direction.

An advantage of this invention is to provide seams made on the outside of the garment to avoid interference with body parts.

Another advantage is to provide bonded seams wherein maximum adhesive shear strength is utilized.

Another object of this invention is to provide seams that avoid overlap at the junction of two non-parallel fold lines.

Yet another object of this invention is to provide bonded seams that have a uniform number of plies along the folded margins.

Another object is to provide garments with a front panel comprised of two partially overlapped half panels where the space between the overlapped portions defines a front opening, and opposing edges of the overlapped portions of the opening are enclosed by a V-folded strip for reinforcing.

Another object of the invention is to provide garments having two front half panels, each having a width equal to half the product plus a pre-selected amount equal to the overlap.

Another object of this invention is to provide garments having front panels with a shaped cutout in at least one panel for a neck opening.

An important object of the invention is to provide folded seams that enclose outwardly facing segment cut edges.

These and other objects and advantages of the invention will become more fully understood from the following detailed description of the invention when read in conjunction with the drawings.

BRIEF DESCRIPTION OF THE DRAWINGS

FIG. 1 is a cross sectional view illustrating a typical seam in a textile article of apparel (Prior Art).

FIG. 2 is a cross sectional view illustrating folds along margins and adhesive bonding of top and bottom panels to form an internal seam (Prior Art).

FIG. 3 is another embodiment similar to FIG. 2 illustrating an internal seam that includes an unfolded top panel (Prior Art).

FIG. 4 is a cross sectional view of a seam according to the invention illustrating typical panel to panel adhesively bonded along margins of two panels to form external seams.

FIG. 5 is a cross sectional view of a seam according to this invention illustrating a three panel garment with a front panel comprised of two half width overlapped panels having reinforced edges enclosed by flaps extending from a full width rear panel and external side seams.

FIGS. 6 A–6 E are plan views of panel components for boxer shorts illustrating the arrangement and sequence of assembly.

FIG. 7 A–7 B are respective front and rear views of a vest seamed and assembled according to the invention.

FIG. 8 is a front view of a pair of pants illustrating seams and front opening features.

FIG. 9 is a front view of a gown illustrating another product of this invention.

FIG. 10 is a front view of a dress shirt illustrating the front opening panel conbination connected to the rear panel along margins and including accessory parts and a collar.

FIGS. 11–12 are respective plan views of a shoulder piece and collar blank.

FIGS. 13–17 are perspective views of the collar blank illustrating folds and attachment to the shirt.

DETAILED DESCRIPTION

Figure 18:
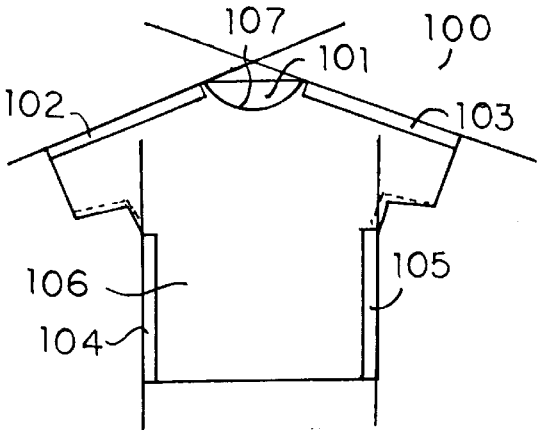
FIG. 18 is a front view of a T-shirt without a front opening.

FIG. 1 is a typical panel to panel edge seam for textile garments having a top or rear panel 1 and a bottom or front panel 2, shown after the seam is completed and the garment is everted to form an internal seam 3 with stitching 4 joining edge 5 to edge 6.

Because textile fabrics have long fibers, these inside seams are not uncomfortable to garment wearers.

To avoid turning the garment inside out after sewing, the prior art teaching of FIG. 2 includes seams made by bonding prefolded panel 7 to prefolded panel 8 with adhesive 9 to form an internal seam 10, as described in U.S. Pat. No. 3,036,311 for neckties.

In FIG. 3 (also from '311), a non folded rear panel 11 is attached to panel 12 with adhesive 14 along prefolded edge 13 to form an internal seams having exposed cut edges 15 facing outward. The seams of FIGS. 2 and 3 are not compatable with production methods described in U.S. Pat. No. 5,795,433 because any excess adhesive would contaminate the bearing surface of the carrier drum used for folding/seaming of garment margins.

In FIG. 4, panel 16 is superposed on panel 17 before adhesive 18 is applied on marginal edges of (top) panel 16.

Panel 17 is larger than panel 16 because of extended flaps 19 (shown dotted in phantom before folding). After adhesive 18 is applied to top panel 16, extended flaps 19 are folded as at 19' to form seams 20 along pre-selected margins of the garment.

Figure 20:
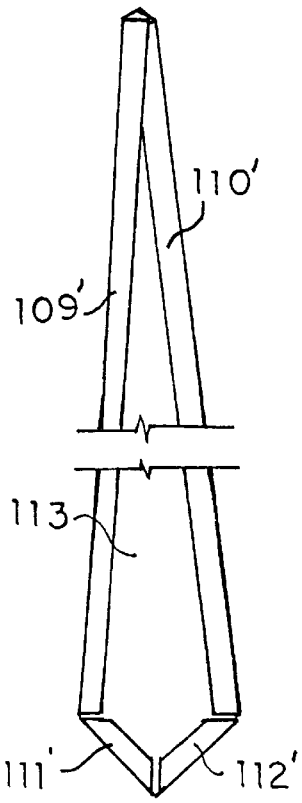
FIG. 20 is a rear view of the necktie in FIG. 19 illustrating seam foldover and overlap at the narrow end of the necktie.
Figure 19:
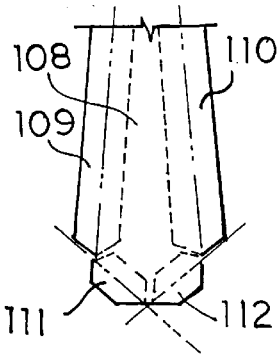
FIG. 19 is a front view of a necktie illustrating unfolded longitudinal side extensions and end flaps for making folds at ends of the necktie.

The embodiment of FIG. 4 is used to fabricate and assemble garments not having any requirement for front openings, such as, T-shirts and neckties (see FIGS. 19 and 20).

FIG. 5 is similar to FIG. 4 but includes a top panel comprising half width panel 21 overlapping half width panel 22 to form opening 23 which can be closed using adhesive 24 to attach reinforcing strip 25 to reinforcing strip 26.

Reinforcing strip 25 is coated with adhesive 24 which is pressed against release coated area 27 of strip 26 for a reclosable opening, but other well known closures can be used, for example, interlocking male/ female strips (like Ziplock) or, cooperating interlocking fiber/loop strips (like Velcro) similar to the strip segments of FIG. 5 in U.S. Pat. No. 3,824,625.

When joined by closures or adhesives, the combined front panel made from two half width panels 21, 22 is superposed on panel 28 before extensions 19 are folded over (as at 19') to bond half width panels 21, 22 to full panel 28 with adhesive 18 (similar to the construction of FIG. 4).

In FIG. 6A, left hand panel segment 29 includes flap 30 which is subsequently folded (see 30' of FIG. 6E) and central extended flap 31 which is reverse folded as at 31' and adhered to the rear of panel 29.

It is expressly noted that panel 29 and other panels referred to hereinafter as being half width (including mirror image panel 34) are slightly wider than half the garment width by an amount 32 extending beyond line 33–33' (toward the right in FIG. 6A), reference hereinafter to 'half width' being made for brevity.

FIG. 6B illustrates a mirror image 'half width' panel 34 having leg flap 35 which is reverse folded as at 35' (see also 35' in FIG. 6E).

Panel 34 also includes an extended central flap 36 which is folded back and adhered to area 36' of full width (rear) panel 37 (see FIG. 6D).

FIG. 6C shows panel 34 superposed on top of panel 29 to provide an area of overlap equal to 32 plus 32'.

In FIG. 6D, full width panel 37 has co-extensive leg flaps 38, 39 which are folded over and attached to the inside surface of panel 37, as at 38', 39' respectively. In this manner, leg flaps on front panels 29 and 34 as well as rear panel 37 are folded, and after panels are joined, provide reinforced leg openings 40, 41 (see FIG. 6E).

Panel 37 includes a co-extended central flap 42 which is folded and attached to a frontal area of panel 34 (see 42' of FIG. 6E).

Referring back to FIG. 6D, panel 37 also includes co-extended side flaps 43, 44 which are folded and attached to areas 43', 44' of front panels 29 and 34 respectively.

FIG. 7A is a front view of an assembled vest 45 including rear panel 46 which is attached at top margins 51', 52' to right front panel 47 and left front panel 48. The front panels are superposed to provide overlapped area 49. The panels may be secured using release tape 50.

In FIG. 7A, top flaps 51, 52 are extensions of rear panel 46 along top margins 51', 52'.

Flap 51 extending from rear panel 46 folds over the top margin edge 51' for attachment to front half panel 48.

Flap 52 extending from rear panel 46 folds over the top margin edge 52' for attachment to front half panel 47.

In FIG. 7 B, top flaps 51, 52 and side flaps 53, 54 are parts of, and extend from, rear panel 46.

Top and side flaps are folded around marginal edges and secured to front panels 47, 48 as in FIG. 7A.

FIG. 8 illustrates an assembled pair of pants 55 comprised of full rear panel (not shown) and flaps on margins 56–59 which are subsequently folded over as at 56'–58' to enclose coacting portions of front panels 60,61 as at 56', 58' to form a left leg and as at 57',59' to form a right leg.

Front panels 60, 61 are overlapped in a central area 62 and are connected to the full width rear panel (not referenced) by bonded attachment of flap 63 located centrally and extending from the rear panel. Flap 63 is folded over and attached to front panel 61.

FIG. 9 illustrates a gown 64 comprised of a rear panel 65 with extensions that are folded as at 66, 66', 67, and 67' to attach the rear panel 65 to each of the front half-width panels 68, 69. Panels are overlapped as at 70 and tapes 71 are provided for closure.

In FIG. 10, the assembled dress shirt 72 is comprised of a full rear panel 73, left and right half-width panels 74 and 75 respectively, each having the overlapped central edges shown in FIG. 5.

Co-extensive flaps of the rear panel are folded over as at 77,78,79, and 80 to form a compound shape along the shoulders and upper arm margins, and side margins at 81, 82 for joining the front and rear parts of the shirt.

In addition, a shoulder reinforcing piece 83 (FIG. 11) is attached to the back of the rear panel (see FIG. 14) with extension flaps 84, 85 folded along shoulder margins over the already folded extension flaps 78, 79 (see 84' and 85' of FIG. 14).

In FIG. 12, the pre-cut collar blank comprising a first portion 89 is folded along F1–F1'. Side flaps 91, 92 are folded along F3–F3' and F4–F4' respectively before a second panel conprising both folded portions 89 and 90 are folded along line F2–F2', as shown in FIG. 13.

A pre-printed 'button strip' 86 and pocket 87 are attached primarily for decorative purposes. Velcro, release tabs, or a 'zip strip' can be attached to the inside opposing surfaces of the reinforcing strips 76 for opening/closing of the shirt.

The folded collar of FIG. 13 is turned upside down and a central extended portion 88 is attached to the back side of rear panel 73 (see 88' of FIG. 14) before the collar is subsequently folded into the triangular configuration of FIG. 17. The collar configuration allows attachment along adhesively coated margins of a V-shaped cutout shaped in the superposed front panel combination.

FIG. 11 illustrates the shoulder piece 83 with flaps 84, 85 which are folded as described above.

FIG. 12 is a die cut segment that is folded in separate operations into the folded collar shown in FIG. 13. In FIG. 12, an upper collar portion 89 is folded about line F1–F1' to be superposed and adhesively attached to portion 90. Side tabs 91, 92 of the collar are then folded about lines F3–F3', F4–F4' on both sides and bonded to portion 90 at the tapered ends. Superposed and bonded panels 89, 90 are then folded about line F2–F2'.

The now pre-folded collar with four soft edges 93,94,95, 96 (FIG. 13) is subsequently attached to the rear panel of the shirt.

FIG. 14 illustrates the orientation of the pre-folded collar for attachment to the underside of the rear panel 73. Once the collar is attached, outwardly extending tab ends 97,98 are rotated about fold line F5–F5' as in FIG. 15 until they are completely C-folded as shown in FIG. 16.

Subsequently, the overlapped tab end 98 is displaced along central line 99–99' into the triangular shaped fold configuration of FIG. 17.

In FIG. 18, as assembled T-shirt 100 comprised of a rear panel 101 having shoulder flaps 102, 103 and side flaps 104,105 is superposed with a similarly shaped front panel 106 having a neck cutout 107. As described in FIG. 4, the extended flaps are folded and attached with adhesive applied to the receptor areas underlying the flaps as shown.

FIG. 19 shows necktie front panel 108 having extended side flaps 109,110 and tip extensions 111, 112 before folding/seaming assembly over rear panel 113 (see FIG. 20).

In FIG. 19, material between adjacent flaps is removed as required to avoid interference between flaps after folding.

In FIG. 20, front panel flaps are shown after folding at positions 109', 110' along the side margins, and 111', 112' at the tip. Similar tip extension folds can be made at the narrow end but are not detailed for clarity.

Side flap extensions will generally be from about ¾" to 1" wide. At the narrow end of the necktie therefore, a width of less than about 1 ¼" requires that the second side margin is folded after the first side margin is folded and adhesive is applied to the receptor area of the first folded margin where overlap would occur.

Figure 21:
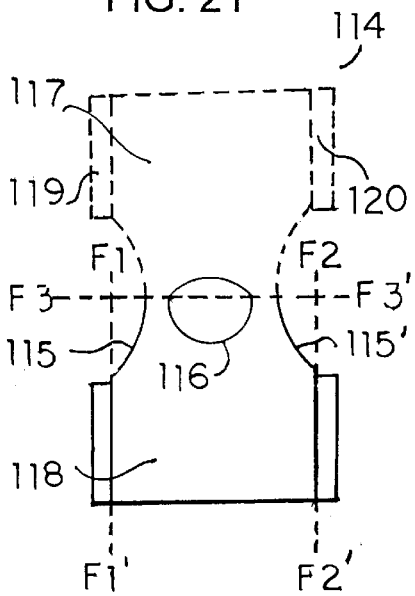
FIG. 21 is a plan view of a segment before folding about atransverse fold line to create the undershirt illustrated.

In FIG. 21, segment 114 includes cutouts 115, 115' along side margins oriented symmetrically about neck cutout 116.

A cutout 116 is asymmetrical relative to fold line F3–F3'. Upper portion 117 (shown in phantom lines for clarity) is subsequently folded along line F3–F3' to form the rear panel 117 (see FIG. 22) of the completed undershirt.

Figure 22:
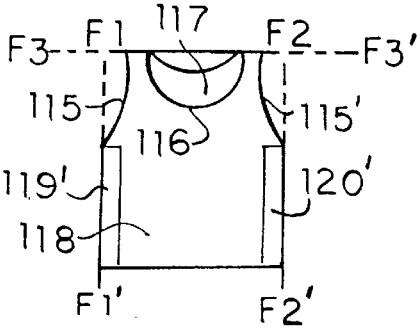
FIG. 22 is a plan view of the segment in FIG. 21 after folding.

In FIG. 21, front panel flaps 119, 120 extending from side margins of rear panel 117 are folded along side margin fold lines F1–F1' and F2–F2' and attached to front panel 118 as at 119' and 120' of FIG. 22.

Figure 23:
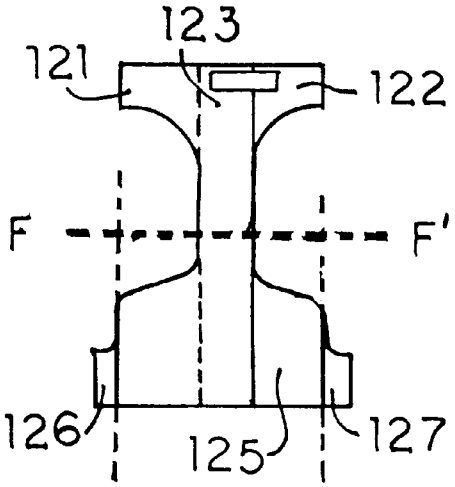
FIG. 23 is a plan view of the two overlapped half width segments with upper and lower portions equidistant from, and before folding around, a transverse fold line.
Figure 24:
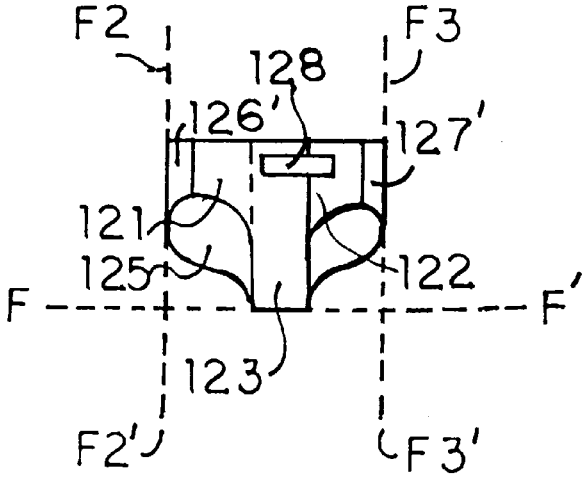
FIG. 24 is a plan view of the overlapped segments of FIG. 23 after folding and seaming to create a front panel opening.

FIG. 23 shows a full length half width segment panel 121 partially overlapping, and superposed on top of, a similarly shaped full length half width segment 122 to create a centrally located overlapped region 123 in the portion that becomes the front panel after transverse folding (see FIG. 24).

Before segments 121,122 are superposed, adhesive is applied to the central overlapped area 123 in the portions that become the rear panel after transverse folding, therfore, contacting surfaces of the overlapped segments are attached in area 123 and become the functional equivalent of a full width rear panel 125 (see FIG. 24).

FIG. 23 shows side flaps 126 extending from the left side half width segment and side flap 127 extending from the right side half width segment. In FIG. 24, side flaps are folded, sealed, attached to, and enclose, the front panel formed from narrower segments 121,122.

In FIG. 23, area 123 above fold line F1–F1' is not printed with adhesive, therefore contacting surfaces between segments 121,122 are openable without restraint.

In FIG. 23, the overlapped area below F–F' between half panels 121 and 122 is printed with adhesive to bond the two half panels into a unitary full width rear panel 125.

In FIG. 24, the front upper panel is folded around F–F', and side flaps 126, 127 extending from unitary rear panel 125 are folded around side margins F2–F2' and F3–F3' and attached to side margins of the front half panels, as at 126' and 127' respectively.

In FIG. 24, a release tape 128 is used to keep the front opening closed for wear.

Figure 25:
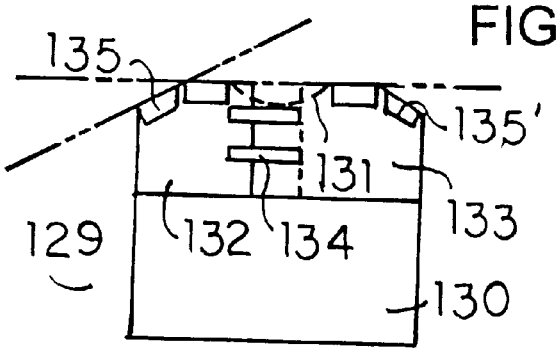
FIG. 25 is a rear plan view of a bib having a reclosable rear panel, sloped shoulders, and a full front panel of extended length.

In FIG. 25, bib 129 includes a front panel 130 with a neck opening 131 (shown in phantom) but does not have side margin connections, thus, making it easier to put on a child or disabled person.

The rear panel is comprised of two half width panels 132,133 connected with release tape 134 and panels 132, 133 are bonded to the panels 132,133 being bonded to the front panel 130 by the foldover and securing of tabs 135, 135'.

While in the foregoing specification a detailed description of an embodiment of the invention has been set forth for the purpose of illustration, many variations can be made in the details stated herein without departing from, or limiting, the spirit and scope of the invention. It is within the scope of the invention to define other articles of apparel according to the claims made hereinafter.

I claim:

1. An article of apparel comprising a first segment and a second segment, said first segment having co-extensive flaps along selected margins, said second segment being smaller than said first segment, having substantially the same shape, and being superposed against said first segment, said first and second panel segments being connected by folding and bonding said flap extensions along at least two margins which are substantially parallel to a central line that bisects the article of apparel into two symmetrical half portions, and at least one flap folded around a margin at an angle to said central line, said folded extensions of said first segment enclosing said second segment to create external seams along said margins.

2. The article of apparel of claim 1 wherein said second segment is comprised of:

two shaped segments, each having a width substantially equal to one half the width of said apparel article, and, said half width segments being superposed and partially overlapped in a central area, said half width segments being arranged in mirror image relationship symmetrically about said central line.

3. The apparel article of claim 2 wherein edges of said two half width segments nearest said overlapped region are enclosed by, and bonded to, a folded strip.

4. The apparel article of claim 2 wherein a portion of said half width panel segments is cut to provide a V-shaped front neck opening.

5. The apparel article of claim 2 wherein an extension of a pre-folded collar is adhesively attached to the rear of a full width panel, with collar end tabs aligned perpendicular to said central line for subsequent folding into a triangular configuration and adhesive attachment along said V-shaped neck cutout.

6. The apparel article of claim 2 wherein said overlapped half width segments are joined for closure with protruding elements on a first half width segment coacting with loop elements on a second half width segment.

7. The apparel article of claim 2 wherein adhesively coated tapes attach to a release coated surface of an underlying segment to close a front panel opening between half width segments.

8. The apparel article of claim 2 wherein an element attached to a first half width segment has at least one longitudinally extended protrusion for insertion into, and cooperation with, an element attached to a second half width segment and having a longitudinally extending depression to affect closure between said first and second segments.

9. The apparel article of claim 2 wherein said flaps are eliminated to avoid connection between said front and rear panels along said side margins.

10. The apparel article of claim 9 wherein only one end of the article has folds according to the defined angle.

11. The apparel article of claim 1 wherein two of said fold lines at an angle to said central line form an angle having its apex coincident with, and symmetrical about the central line at both ends of the product.

* * * * *